United States Patent [19]

Hasegawa et al.

[11] Patent Number: 4,503,829

[45] Date of Patent: Mar. 12, 1985

[54] FUEL SUPPLY CONTROL METHOD FOR INTERNAL COMBUSTION ENGINES UNDER HIGH LOAD CONDITIONS

[75] Inventors: Shumpei Hasegawa, Niiza; Yutaka Otobe, Shiki, both of Japan

[73] Assignee: Honda Giken Kogyo Kabushiki Kaisha, Tokyo, Japan

[21] Appl. No.: 552,485

[22] Filed: Nov. 16, 1983

[30] Foreign Application Priority Data

Nov. 19, 1982 [JP] Japan ..... 57-203292

[51] Int. Cl.[3] ..... F02B 3/00

[52] U.S. Cl. ..... 123/492

[58] Field of Search ..... 123/492

[56] References Cited

U.S. PATENT DOCUMENTS 4,334,513 6/1982 Nakajima ..... 123/492
4,359,993 11/1982 Carlson ..... 123/492
4,413,602 11/1983 Inoue ..... 123/492
4,440,119 4/1984 Kobayashi ..... 123/492

*Primary Examiner*—Ronald B. Cox
*Attorney, Agent, or Firm*—Lyon & Lyon

[57] ABSTRACT

A fuel supply control method for an internal combustion engine, in which while the rotational speed of the engine is lower than a predetermined value, the mixture is enriched either when a detected value of absolute pressure in the intake pipe of the engine is higher than a first predetermined value or when a detected value of the throttle valve opening is larger than a predetermined value, whereas while the rotational speed of the engine is higher than the predetermined value, the mixture is enriched when a detected value of the intake pipe absolute pressure is higher than a second predetermined value, thereby preventing an excessive increase in the bed temperature of the catalyst device of the engine, as well as ensuring required output performance of the engine.

6 Claims, 6 Drawing Figures

EXHAUST GAS PURIFYING DEVICE
14
15
$O_2$
13
1
INTERNAL COMBUSTION ENGINE
12
CYL
Ne
11
Tw
10
6
FUEL INJECTION VALVE
9
TA
2
7
8
PBA
3
4
θth
BATTERY
18
PA SENSOR
16
STARTING SW
17
ECU
5

FUEL SUPPLY CONTROL METHOD FOR INTERNAL COMBUSTION ENGINES UNDER HIGH LOAD CONDITIONS

BACKGROUND OF THE INVENTION

This invention relates to a fuel supply control method for internal combustion engines under high load conditions, and more particularly to a fuel supply control method of this kind which is adapted to enrich a mixture being supplied to the engine so as to avoid an excessive rise in the bed temperature of a catalyst device provided in the engine when the engine is operating in high load regions.

In internal combustion engines in general, a mixture being supplied to the engine is enriched when the engine is operating under high load conditions such as at quick acceleration, so as to achieve required high engine output, thereby improving the driveability of the engine.

On the other hand, a catalyst device provided in the exhaust system of an internal combustion engine is generally adapted to show maximum conversion efficiency of exhaust gas ingredients and exhibit the best exhaust gas purifying function when the air-fuel ratio of the mixture assumes a value equal to a stoichiometric mixture ratio or a value in the vicinity thereof. However, in a high load region of the engine, as described later, the catalyst device has an increased reaction rate when the mixture assumes an air-fuel ratio equal to the stoichiometric ratio or a value in the vicinity thereof. Depending upon the operating conditions of the engine, the temperature of the catalyst bed can rise to an excessive degree, even resulting in burning of the catalyst bed. Such excessive rise of the bed temperature can be restrained by enriching the mixture as mentioned above. However, enriching of the mixture will cause a degradation in the exhaust gas purifying function of the catalyst device.

In view of the above circumstances, it is necessary to discriminate proper mixture-enriching high load regions of an internal combustion engine from other operating regions of the engine so as to achieve prevention of excessive rise of the catalyst bed temperature as well as to improve the output performance and emission characteristics of the engine, at the same time.

Conventionally, setting of such mixture-enriching high load regions of an internal combustion engine has been made on the basis of the throttle valve opening.

The catalyst bed temperature increases with an increase in the weight flow rate of intake air $G_{AIR}$ drawn into the engine, and the weight flow rate of air is in turn variable as a function of the rotational speed of the engine and the absolute pressure within the intake pipe of the engine. Therefore, if in a high speed region of the engine where the weight flow rate of air is relatively large the air-fuel ratio of the mixture is set to a value equal to a stoichiometic mixture ratio or a value in the vicinity thereof, the catalyst bed temperature can rise excessively, providing a larger possibility of burning of the catalyst bed than in a low speed region of the engine.

To solve this problem, it has been proposed, e.g. by Japanese Provisional Utility Model Publication No. 53-22928 to set a predetermined throttle valve opening value for determining a mixture-enriching high load region of an internal combustion engine, to a predetermined value smaller in a high speed region of the engine than in a low speed region of the engine. However, since this proposed method depends solely upon the throttle valve opening to set the mixture-enriching high load region of the engine throughout the whole engine rotational speed range, enrichment of the mixture cannot take place in a certain region in the above high engine speed region where the throttle valve opening is smaller than the above predetermined value and the intake pipe absolute pressure is higher than a certain value, thereby providing a possibility of excessive rise of the catalyst bed temperature.

In view of the aforementioned fact that the catalyst bed temperature varies in response to the weight flow rate of air drawn into the engine being a function of the engine rotational speed and the intake pipe absolute pressure, proper setting of the mixture-enriching high load region of the engine can be made for better prevention of excessive rise of the catalyst bed temperature, if such setting is made on the basis of the intake pipe absolute pressure as well as the engine rotational speed.

Further, in high altitudes the weight flow rate of air drawn into the engine is smaller than in lowlands so that the possibility of excessive rise of the catalyst bed temperature is reduced when the engine is operating in high altitudes, so long as the engine is operating under the same operating conditions as in lowlands. Therefore, according to the above proposed method depending upon the throttle valve opening alone to set the mixture-enriching high load region, if it is desired to obtain the same results during engine operation in high altitudes as in lowlands, it will be required to correct the predetermined throttle valve opening value for determining the mixture-enriching high load region to a larger value than that applied during engine operation in lowlands. This makes complicate in structure a fuel supply control system to which the method is applied.

Moreover, provided that the throttle valve opening is maintained at a constant value, the intake pipe absolute pressure lowers as the engine rotational speed increases. Therefore, if setting of the mixture-enriching high load region of the engine is made on the basis of the engine rotational speed and the intake pipe absolute pressure alone, there can exist a region where the mixture is not enriched even when the operator steps on the accelerator pedal to accelerate the engine. Thus, in such region required accelerating performance cannot be obtained, but also the catalyst bed temperature can rise excessively.

SUMMARY OF THE INVENTION

It is an object of the invention to provide a fuel supply control method for an internal combustion engine, which is capable of setting mixture-enriching high load regions of the engine so as to avoid excessive rise of the catalyst bed temperature substantially completely throughout the whole engine rotational speed range, without spoiling the output performance and emission characteristics of the engine.

It is a further object of the invention to provide a fuel supply control method for an internal combustion engine, which is capable of setting a mixture-enriching high load region without the need of correcting a predetermined value of a parameter for determining such region during operation of the engine in high altitudes, thereby permitting simplification of a fuel supply control system to which the method is applied.

It is a still further object of the invention to provide a fuel supply control method for an internal combustion engine, which is capable of setting a mixture-enriching high load region so as to avoid excessive rise of the catalyst bed temperature without spoiling the accelerating performance of the engine.

According to the invention, there is provided a fuel supply control method of electronically controlling the quantity of fuel being supplied to an internal combustion engine having an intake passage, and a throttle valve arranged in the intake passage, in response to operating conditions of the engine, so as to achieve desired air-fuel ratios of a mixture being supplied to the engine. The method according to the invention is characterized by comprising the following steps: (a) detecting the rotational speed of the engine; (b) detecting absolute pressure in the intake passage of the engine at a zone downstream of the throttle valve therein; (c) detecting the valve opening of the throttle valve; (d) comparing a detected value of the rotational speed of the engine with a predetermined value; (e) comparing a detected value of the intake passage absolute pressure with a first predetermined value and also comparing a detected value of the throttle valve opening with a predetermined value, when the detected value of the rotational speed of the engine is lower than the predetermined value thereof; (f) determining that the engine is operating in a first predetermined mixture-enriching region, when at least one of the detected values of the intake passage absolute pressure and the throttle valve opening is higher or larger than a corresponding one of the predetermined values thereof as results of the comparisons of the step (e); (g) comparing the detected value of the intake passage absolute pressure with a second predetermined value, when the detected value of the rotational speed of the engine is higher than the predetermined value thereof; (h) determining that the engine is operating in a second predetermined mixture-enriching region, when the detected value of the intake passage absolute pressure is higher than the above second predetermined value as a result of the comparison of the step (g); and (i) controlling the air-fuel ratio of the mixture to a predetermined value smaller than a stoichiometic mixture ratio, when it is determined in the step (f) or the step (h) that the engine is operating in either of the first predetermined mixture-enriching region or in the second predetermined mixture-enriching region.

Preferably, the above second predetermined value of the intake passage absolute pressure is set at a value lower than the above first predetermined value thereof.

Also, preferably, when the engine is operating in the above first predetermined mixture-enriching region, the above predetermined value of the air-fuel ratio of the mixture is set to smaller values as the detected value of the throttle valve opening assumes larger values.

Further, preferably, when the engine is operating in at least one of the first and second predetermined mixture-enriching regions, the above predetermined value of the air-fuel ratio of the mixture is set to smaller values as the detected value of the intake passage absolute pressure assumes higher values.

The above and other objects, features, and advantages of the invention will be more apparent from the ensuing detailed description taken in conjunction with the accompanying drawings.

DETAILED DESCRIPTION

Details of the invention will now be described with reference to the drawings.

Figure 1:
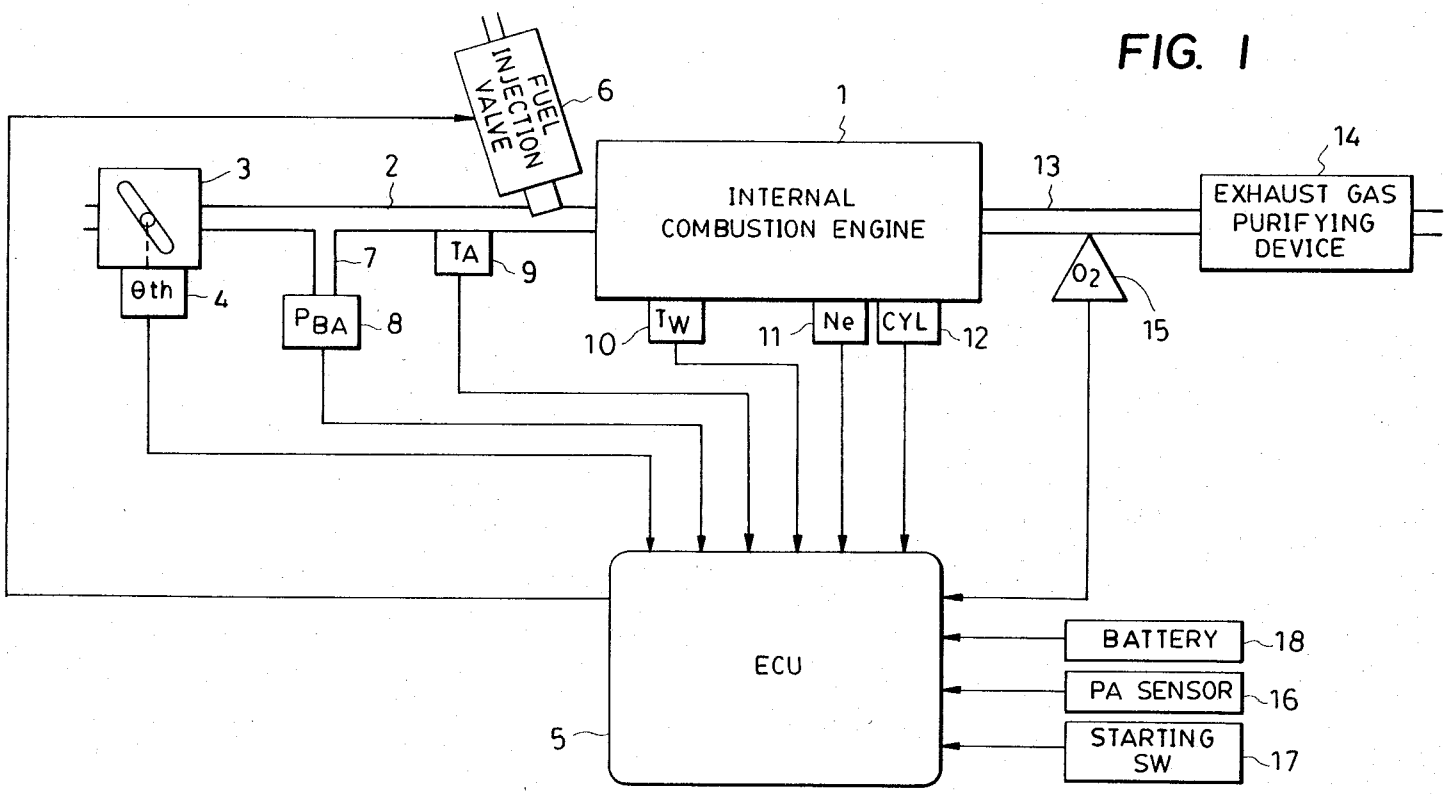
FIG. 1 is a block diagram of the whole arrangement of a fuel supply control system for an internal combustion engine, to which is applied the method according to the invention.

Referring first to FIG. 1, there is illustrated the whole arrangement of a fuel supply control system to which is applied the method according to the invention. Reference numeral 1 designates the main body of an internal combustion engine which may be a four-cylinder type for instance. Connected to the main body 1 of the engine is an intake pipe 2 in which is arranged a throttle valve 3. Connected to the throttle valve 3 is a throttle valve opening sensor ($\theta$th sensor) 4 which detects the valve opening $\theta$th of the throttle valve 3 and supplies a signal indicative of a detected valve opening value to an electronic control unit (hereinafter called "the ECU") 5. Fuel injection valves 6, which may be four for instance, and only one of which is shown, are disposed in the intake pipe 2 at a location intermediate between the main body 1 of the engine and the throttle valve 3 and slightly upstream of their respective intake valves. Each of the fuel injection valves 6 is connected to a fuel pump, not shown, and is electrically connected to the ECU 5 to have its valve opening period by a driving signal supplied from the ECU 5.

On the other hand, an absolute pressure sensor (hereinafter called "the PBA sensor") 8 is connected to the intake pipe 2 through a conduit 7 at a location immediately downstream of the throttle valve 3. The PBA sensor 8 detects the absolute pressure within the intake pipe 2 and supplies a signal indicative of a detected absolute pressure value to the ECU 5. Mounted in the intake pipe 2 at a location immediately downstream of the PBA sensor 8 is an intake air temperature sensor (PA sensor) 9 which detects the temperature of intake air flowing in the intake pipe 2 and supplies a signal indicative of a detected intake air temperature value to the ECU 5. An engine cooling water temperature sensor (TA sensor) 10 is mounted on the main body 1 of the engine. This sensor 10 is composed of a thermistor or a like device, inserted into the peripheral wall of a cylinder of the engine to detect the temperature TW of the engine cooling water filled therein and supply a signal indicative of a detected water temperature value to the ECU 5.

An engine rpm sensor (hereinafter called "the Ne sensor") 11 and a cylinder-discriminating sensor (CYL sensor) 12 are disposed around a camshaft of the engine or a crankshaft thereof, neither of which is shown. The former is adapted to generate one pulse as a TDC signal at a particular crank angle each time the engine crankshaft rotates through 180 degrees, while the latter is adapted to generate one pulse as a cylinder-discriminating signal (CYL signal) at a particular crank angle of a particular engine cylinder, the pulses generated from the sensors being supplied to the ECU 5.

An exhaust gas purifying device 14, which is composed of a catalyst, e.g. a three-way catalyst, is arranged in an exhaust pipe 13 extending from the main body 1 of the engine, for purifying ingredients HC, CO and NOx contained in the exhaust gases emitted from the engine. An $O_2$ sensor 15 is projected into the exhaust pipe 13 at a location upstream of the exhaust gas purifying device 14, to detect oxygen concentration in the exhaust gases and supply a signal indicative of a detected concentration value to the ECU 5.

Further electrically connected to the ECU 5 are an atmospheric pressure sensor (PA sensor) 16, a starting switch 17 for turning on and off the starter, not shown, of the engine, a battery 18, which supply a signal indicative of a detected atmospheric pressure value, a signal indicative of on and off states of the starter switch, and a battery output voltage to the ECU 5, respectively.

The ECU 5 operates on various signals indicative of detected engine operation parameters from the above-mentioned various sensors, to determine operating conditions of the engine therefrom and calculate the fuel injection period TOUT, i.e. the valve opening period of the fuel injection valves 6, according to the following equation in synchronism with generation of the aforementioned TDC signal in response to the determined operating conditions of the engine:

$$TOUT = Ti \times K_1 + K_2 \quad (1)$$

where Ti represents a basic value of the fuel injection period or valve opening period of the fuel injection valves 6, which is read from a storage means in the ECU 5 as a function of the intake pipe absolute pressure PBA and the engine rpm Ne, and $K_1$ and $K_2$ are a correction coefficient and a correction variable, respectively, which are calculated by respective predetermined equations on the basis of the values of the engine operation parameter signals from the aforementioned various sensors, so as to optimize the operating characteristics of the engine such as startability, emission characteristics, fuel comsumption, and accelerability.

The correction coefficient $K_1$ is given by the following equation as a product of the values of an $O_2$ sensor output-responsive feedback correction coefficient $KO_2$, a mixture-leaning coefficient KLS, an intake air temperature-dependent correction coeffecient KTA, an engine water temperature-dependent fuel increasing coefficient KTW, an after-fuel cut fuel increasing coefficient KAFC, an atmospheric pressure-dependent correction coefficient KPA, an after-start fuel increasing coefficient KAST, and a mixture-enriching coefficient KWOT:

$$K_1 = KO_2 \times KLS \times KTA \times KTW \times KAFC \times KPA \times KAST \times KWOT \quad (2)$$

Of the above coefficients, the mixture-enriching coefficient KWOT is a correction coefficient according to the method of the invention, the value of which is determined in a manner described hereinafter.

The ECU 5 supplies driving signals corresponding to the fuel injection period TOUT calculated as above by the equation (1) to the fuel injection valves 6 to energize same.

Figure 2:
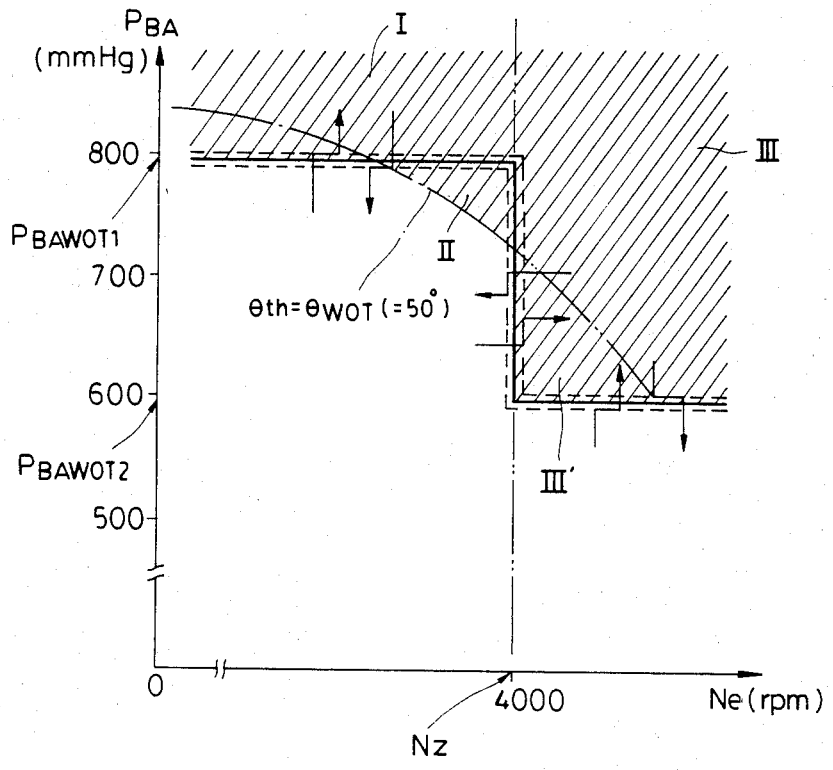
FIG. 2 is a graph showing an example of setting of mixture-enriching high load regions of the engine, according to the method of the invention.

FIG. 2 shows an example of setting of mixture-enriching regions or predetermined high load regions of the engine according to the invention. The mixture-enriching regions comprises a region I where the engine rpm Ne is smaller than a predetermined value Nz and at the same time the intake pipe absolute pressure PBA is higher than a first predetermined value PBAWOT1, a region II where the engine rpm Ne is smaller than the predetermined value Nz and at the same time the throttle valve opening $\theta$th is larger than a predetermined value $\theta$WOT1, and a region III where the engine rpm Ne is larger than the predetermined value Nz and at the same time the intake pipe absolute pressure PBA is higher than a second predetermined value PBAWOT2. According to the invention, the mixture being supplied to the engine is enriched for prevention of excessive rise of the bed temperature of the exhaust gas purifying device 14 in FIG. 1 while the engine is operating in any of these high load regions I, II, and III.

The three-way catalyst arranged in the exhaust system of the engine has the nature that its bed temperature can rapidly rise and even above its allowable maximum bed temperature, if the air-fuel ratio of the mixture assumes a value equal to a stoichiometric mixture ratio or a value in the vicinity thereof when the engine is operating in a high load region as mentioned above. The higher the intake pipe absolute pressure, the larger the rate of increase of the bed temperature is. That is, if the engine is supplied with a mixture having an air-fuel ratio equal to the stoichiometric mixture ratio or a value in the vicinity thereof while it is operating in a high load region, the efficiency of combustion within the engine cylinders increases so that the substantial heating value of the mixture per unit mass increases, resulting in increased exhaust gas temperature. This is conspicuous particularly in an internal combustion engine equipped with a supercharger. The higher the exhaust gas temperature, the more the catalyist reaction is promoted, which in turn causes a rise in the temperature of the catalyst bed. Further, in respect of the rate of reaction-catalyst bed temperature characteristic, it is a general tendency that the larger the flow rate of exhaust gases per unit volume of the catalyst, the more rapidly the catalyst bed temperature rises with an increase in the rate of reaction of the catalyst. Therefore, in a high engine speed region, particularly in a high load region therein where the flow rate of exhaust gases is large, there is a strong likelihood that the catalyst bed rises excessively above the allowable maximum bed temperature.

In view of the above, according to the invention, the second predetermined value PBAWOT2 of intake pipe absolute pressure PBA applied in the region III in FIG. 2 wherein the engine rpm Ne is above the predetermined value Nz is set at a value (594 mmHg) lower than the first predetermined value PBAWOT1 applied in the region I in FIG. 2 where the engine rpm Ne is smaller than the predetermined value Nz.

On the other hand, the region II in FIG. 2 corresponds to a region where the intake pipe absolute pressure PBA will be lower than the first predetermined value PBAWOT1 if in this region the accelerator pedal is stepped on to accelerate the engine so that the throttle valve opening is opened above a predetermined value, e.g. 50 degrees. By enriching the mixture when the engine is operating in this region II, required accelerating performance can be obtained.

In FIG. 2, the region III' falling within the region III, where the throttle valve opening th is smaller than a value indicated by the two-dot chain line, corresponds to a region where the mixture cannot be enriched according to Japanese Provisional Utility Model Publication No. 53-22928, previously referred to. Also in this region III' the engine rpm is so high that there is a strong likelihood that the catalyst bed temperature can rise excessively if the mixture has an air-fuel ratio equal to the stoichiometric mixture ratio or a value in the vicinity thereof. Therefore, according to the invention, the mixture is enriched in this region III', too. If the mixture is enriched, the resulting unburned fuel serves to cool the catalyst bed, thereby preventing rise of the bed temperature above the allowable maximum temperature.

Figure 3:
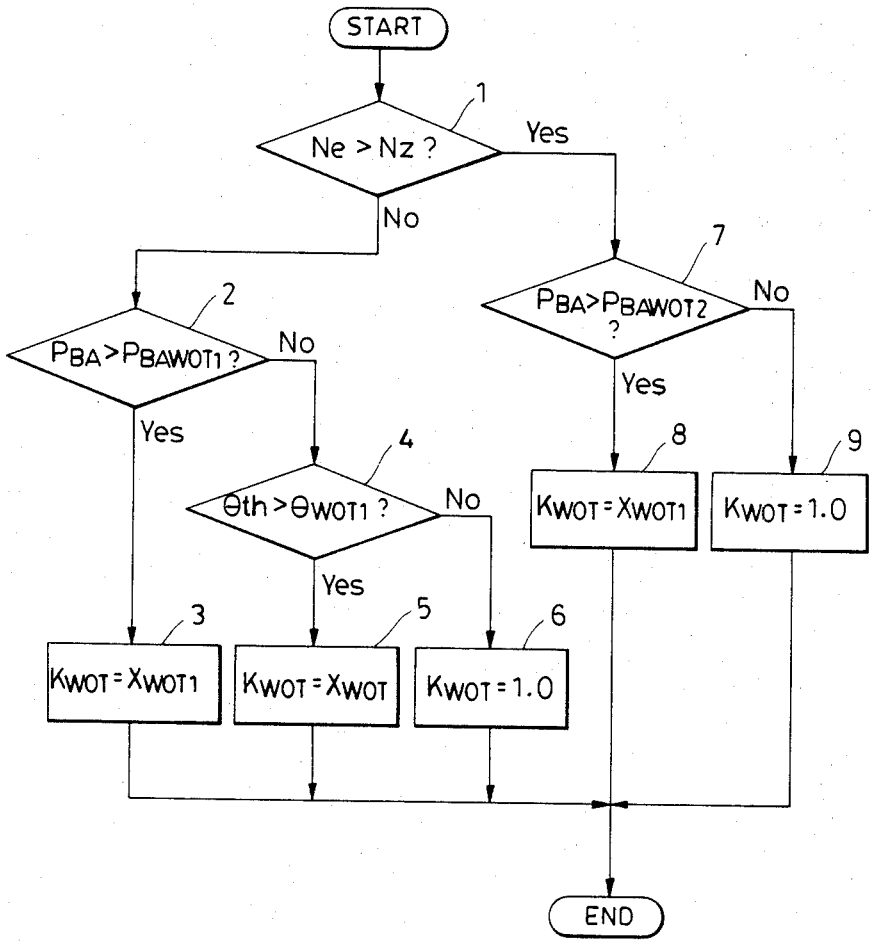
FIG. 3 is a flow chart showing a manner of calculating the value of a mixture-enriching coefficient KWOT according to the method of the invention.

FIG. 3 shows a flow chart of a manner of calculating the value of the mixture-enriching coefficient KWOT according to the method of the invention. It is first determined at the step 1 whether or not the engine rpm Ne is larger than the predetermined value Nz. The predetermined value Nz is set at such a value above which the catalyst bed temperature of the exhaust gas purifying device 14 can rise excessively if the air-fuel ratio of the mixture assumes a value equal to the stoichiometric mixture ratio or a value in the vicinity thereof when the intake pipe absolute pressure PBA exceeds the second predetermined value PBAWOT2. For instance, it is set at 4,000 rpm as shown in FIG. 2.

If the answer to the question of the step 1 is negative, that is, if the engine rpm Ne is smaller than the predetermined value Nz, it is then determined at the step 2 whether or not the intake pipe absolute pressure PBA is higher than the first predetermined value PBAWOT. If the answer is yes, it is determined that the engine is operating in the predeterminede high load region I in FIG. 2 where enrichment of the mixture is required, and the value of the mixture-enriching coefficient KWOT is set to a predetermined value XWOT1 at the step 3, to thereby enrich the mixture being supplied to the engine. This mixture enrichment is particularly desired in a supercharged engine, in which the intake air is pressurized so that the intake air density is increased, resulting an increased heating amount within an engine cylinder. Further, in a supercharged engine in general, the ignition timing is set to be slightly retarded than a non-supercharged engine, for prevention of knocking, and accordingly the exhaust gas temperature can be higher in the supercharged engine. Therefore, the supercharged engine has a stronger possibility of excessive rise of the catalyst bed temperature in the region I, requiring enrichment of the mixture more strongly.

Figure 4:
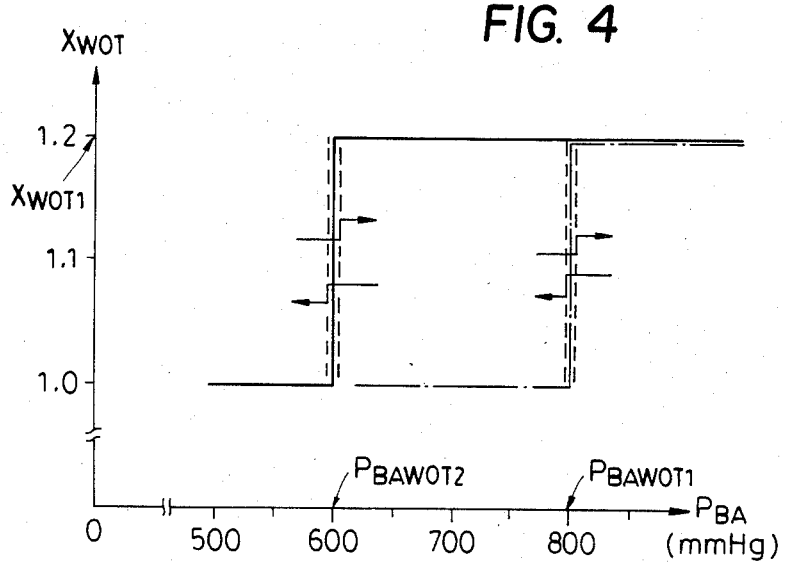
FIG. 4 is a view showing a fuel increasing coefficient value XWOT-intake pipe absolute pressure PBA table according to the example of setting of the mixture-enriching high load regions of FIG. 3.

The first predetermined value PBAWOT1 of intake pipe absolute pressure PBA is set at a value of 794 mmHg for instance, as shown in the XWOT-PBA table indicated by the single-dot chain line in FIG. 4. The predetermined fuel increasing coefficient value XWOT1 is set at such a value as to obtain a required effect of prohibiting the excessive rise of the catalyst bed temperature while the engine is operating in the high load region I. For instance, it is set at a value of 1.2 as in the XWOT-PBA table indicated by the single-dot chain line in FIG. 4. The predetermined value XWOT1 assumes a constant value irrespective of a change in the throttle valve opening $\theta$th.

Figure 5:
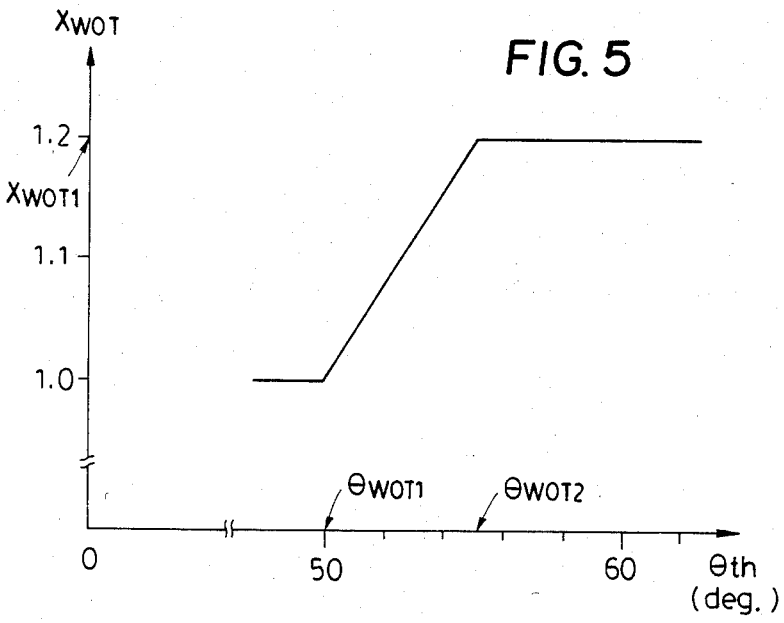
FIG. 5 is a view showing a fuel increasing coefficient value XWOT-throttle valve opening th table according to the example of setting of the mixture-enriching high load regions of FIG. 3.

Referring again to FIG. 3, if the answer to the question of the step 2 is negative, it is then determined at the step 4 whether or not the throttle valve opening $\theta$th is larger than the predetermined value $\theta$WOT1. If the answer is yes, the value of the mixture-enriching coefficient KWOT is set to a predetermined value XWOT at the step 5. This predetermined value XWOT is set in a manner as shown in the XWOT-$\theta$th table in FIG. 5 for instance. According to the table, as the throttle valve opening $\theta$th increases from a predetermined value $\theta$WOT1 (e.g. 50 degrees) to a predetermined value $\theta$WOT2 (e.g. 55 degrees), the value XWOT is gradually increased from 1.0 to the aforementioned predetermined value 1.2, and after the predetermined value 1.2 has been reached, it continues to assume the same value. By thus gradually increasing the rate of enrichment of the mixture in response to an increase in the throttle valve opening $\theta$th, it is possible to avoid a sudden change in the air-fuel ratio of the mixture even caused by a slight change in the amount of stepping-on of the accelerator pedal or the throttle valve opening $\theta$th to thereby prevent a shock given to the operator upon the accelerator pedal being stepped on, that is, to ensure smooth transition from a state in which the mixture is not enriched to a state in which the mixture is enriched.

If the answer to the question of the step 4 is negative, that is, if it is determined that the engine is not operating in the high load region II, the value of the mixture-enriching coefficient KWOT is set to a value of 1.0 at the step 6, thereby prohibiting enrichment of the mixture.

If the answer to the question of the step 1 is yes, that is, if the engine is operating at a rotational speed higher than the predetermined value Nz, it is then determined at the step 7 whether or not the intake pipe absolute pressure PBA is larger than the second predetermined value PBAWOT2. This second predetermined value PBAWOT2 is set at a value of 594 mmHg for instance, as shown in the XWOT-PBA table indicated by the solid line in FIG. 4. If the answer to the question of the step 7 is yes, that is, if the engine is operating in the high load region III in FIG. 2, the value of the mixture-enriching coefficient KWOT is set to the predetermined value XWOT1 at the step 8, thereby enriching the mixture. By thus setting the second predetermined intake pipe absolute pressure value PBAWOT2 applied in the high engine speed region at a value lower than the first predetermined value PBAWOT1 applied in the low engine speed region, the range of the mixture-enriching high load region is expanded in the high engine speed region, thereby ensuring positive prevention of such an excessive rise in the catalyst bed temperature as to cause burning of the catalyst bed.

On the other hand, if the answer to the question of the step 7 is no, that is, if the engine is not operating in the high load region III, the value of the mixture-enriching coefficient KWOT is set to a value of 1.0, thereby prohibiting enrichment of the mixture.

Figure 6:
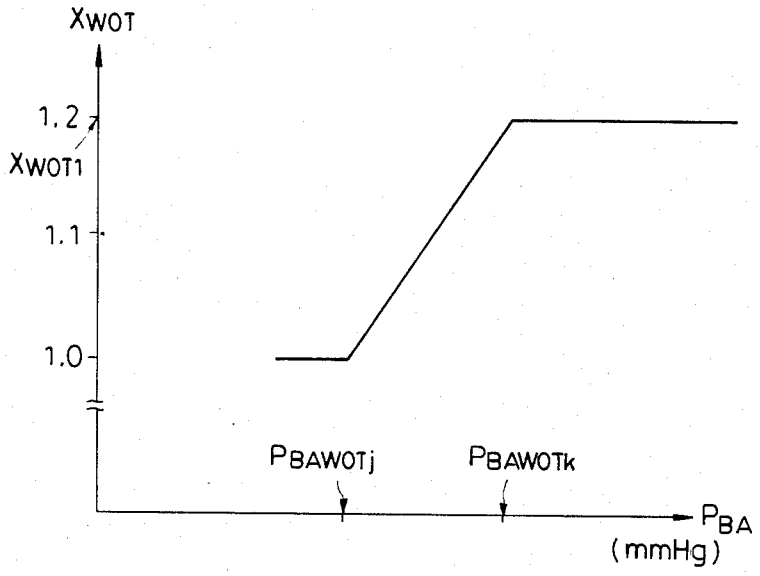
FIG. 6 is a view of another example of the fuel increasing coefficient value XWOT-intake pipe absolute pressure PBA table.

As noted above, in the illustrated embodiment, when the intake pipe absolute pressure PBA exceeds the predetermined value PBAWOTi (i=1, 2, 1 representing the low engine speed region, and 2 the high engine speed region, respectively), the fuel increasing coefficient value XWOT is changed stepwise from 1.0 to the value XWOT1 or 1.2. Alternatively, as shown in FIG. 6, after a predetermined value PBAWOTj (j=1, 2 as applied above) has been exceeded, the fuel increasing coefficient value XWOT may be gradually increased with an increase in the intake pipe absolute pressure PBA, and after a predetermined value PBAWOTk (k=1, 2 as applied above) higher than the value PBAWOTj has been reached, the value XWOT is kept at the constant value XWOT1.

Further, the predetermined values PBAWOT1, PBAWOT2 of intake pipe absolute pressure PBA may each be set to different values between the time the engine enters the corresponding mixture-enriching high load region and the time the engine leaves the same region, as indicated by the broken lines in FIG. 4, thereby preventing the phenomenon that fluctuations in the intake pipe absolute pressure PBA in the vicinity of the same predetermined values cause transitions between a state in which the mixture is enriched and a state in which the mixture is not enriched, and therefore ensuring smooth control of the fuel supply to the engine.

What is claimed is:

1. A method of electronically controlling the quantity of fuel being supplied to an internal combustion engine having an intake passage, and a throttle valve arranged in said intake passage, in response to operating conditions of said engine, so as to achieve desired air-fuel ratios of a mixture being supplied to said engine, the method comprising the steps of: (a) detecting the rotational speed of said engine; (b) detecting absolute pressure in said intake passage of said engine at a zone downstream of said throttle valve therein; (c) detecting the valve opening of said throttle valve; (d) comparing a detected value of the rotational speed of said engine with a predetermined value; (e) comparing a detected value of said intake passage absolute pressure with a first predetermined valve and also comparing a detected value of said throttle valve opening with a predetermined value, when the detected value of the rotational speed of said engine is lower than said predetermined value thereof; (f) determining that said engine is operating in a first predetermined mixture-enriching region, when at least one of the detected values of said intake passage absolute pressure and said throttle valve opening is higher or larger than a corresponding one of said first predetermined value and said predetermined value thereof as results of the comparisons of the step (e); (g) comparing the detected value of said intake passage absolute pressure with a second predetermined value, when the detected value of the rotational speed of said engine is higher than said predetermined value thereof; (h) determining that said engine is operating in a second predetermined mixture-enriching region, when the determined value of said intake passage absolute pressure is higher than said second predetermined value thereof as a result of the comparison of the step (g); and (i) controlling the air-fuel ratio of said mixture to a predetermined value smaller than a stoichiometic mixture ratio, when it is determined in the step (f) or the step (h) that said engine is operating in a corresponding one of said first and second predetermined mixture-enriching regions.

2. A method as claimed in claim 1, wherein said first and second predetermined values of said intake passage absolute pressure are set at values different from each other.

3. A method as claimed in claim 2, wherein said second predetermined value of said intake passage absolute pressure is set at a value lower than said first predetermined value thereof.

4. A method as claimed in claim 1, wherein when said engine is operating in said first predetermined mixture-enriching region, said predetermined value of the air-fuel ratio of said mixture is set to smaller values as the detected value of said throttle valve opening assumes larger values.

5. A method as claimed in claim 1, wherein when said engine is operating in at least one of said first and second predetermined mixture-enriching regions, said predetermined value of the air-fuel ratio of said mixture is set to smaller values as the detected value of said intake passage absolute presssure assumes larger values.

6. A method of electronically controlling the quantity of fuel being supplied to an internal combustion engine having an intake passage, and a throttle valve arranged in said intake passage, in response to operating conditions of said engine, so as to achieve desired air-fuel ratios of a mixture being supplied to said engine, the method comprising the steps of: (a) detecting the rotational speed of said engine; (b) detecting absolute pressure in said intake passage of said engine at a zone downstream of said throttle valve therein; (c) detecting the valve opening of said throttle valve; (d) comparing a detected value of the rotational speed of said engine with a predetermined value; (e) comparing a detected value of said intake passage absolute pressure with a first predetermined value, when the detected value of the rotational speed of said engine is lower than said predetermined value thereof; (f) determining that said engine is operating in a first predetermined mixture-enriching region, when the detected value of said intake passage absolute pressure is higher than said first predetermined value thereof as a result of the comparison of the step (e); (g) comparing the detected value of said throttle valve opening with a predetermined value, when the detected valve of said intake passage absolute pressure is lower than said first predetermined value thereof; (h) determining that said engine is operating in a second predetermined mixture-enriching region, when the detected value of said throttle valve opening is larger than said predetermined value thereof as a result of the comparison of the step (g); (i) comparing the detected value of said intake passage absolute pressure with a second predetermined value, when the detected value of predetermined value thereof; (j) determining that said engine is operating in a third predetermined mixture-enriching region, when the detected value of said intake passage absolute pressure is higher than said second predetermined value thereof; (k) controlling the air-fuel ratio of said mixture to a predetermined value smaller than a stoichiometic mixture ratio, when it is determined in the step (f), the step (h), or the step (j) that said engine is operating in a corresponding one of said first, second and third predetermined mixture-enriching regions.

* * * * *

UNITED STATES PATENT AND TRADEMARK OFFICE

CERTIFICATE OF CORRECTION

PATENT NO. : 4,503,829

DATED : March 12, 1985

INVENTOR(S) : Shumpei Hasegawa and Yutaka Otobe

It is certified that error appears in the above-identified patent and that said Letters Patent are hereby corrected as shown below:

Column 4, line 18, and column 7, line 7:

"th" should be changed to read --θth--.

IN THE CLAIMS:

Claim 1, column 9, lines 52 to 53:

"determined" should be changed to read --detected--;

Claim 6, column 10, line 52:

before "predetermined value" insert --the rotational speed of said engine is higher than said--.

Signed and Sealed this

*Twenty-seventh* Day of *August 1985*

[SEAL]

*Attest:*

DONALD J. QUIGG

*Attesting Officer* *Acting Commissioner of Patents and Trademarks*